US006102834A

United States Patent [19]

Chen

[11] Patent Number: 6,102,834

[45] Date of Patent: Aug. 15, 2000

[54] FLASH DEVICE FOR AN EXERCISE DEVICE

[76] Inventor: Ping Chen, No. 29, Nanmei St., Nantun Li, Nantun Dist., Taichung, Taiwan

[21] Appl. No.: 09/220,815

[22] Filed: Dec. 23, 1998

[51] Int. Cl.[7] ..... A63B 22/06

[52] U.S. Cl. ..... 482/57; 482/63; 482/64; D12/12; 280/281.1; 280/282

[58] Field of Search ..... 482/57, 58, 59, 482/63, 64; D12/12; 280/259, 281, 282

[56] References Cited

U.S. PATENT DOCUMENTS 4,512,566 4/1985 Bicocchi ..... 272/72
5,393,281 2/1995 Chen ..... 482/57
5,584,562 12/1996 Geran ..... 362/72
5,588,939 12/1996 Zheng ..... 482/57

*Primary Examiner*—Stephen R. Crow
*Assistant Examiner*—Tam Nguyen
*Attorney, Agent, or Firm*—Dellett and Walters

[57] ABSTRACT

A flush-mounted device for an exercise device includes a generator having a rotator contacting the flywheel which is connected to the pulley by a belt so that when rotating the crank, the generator is operated. A plurality of bulbs are connected in the casing mounted over the pulley and the flywheel, and the bulbs are electrically connected to the generator so that the bulbs turn on when the generator is operated. The casing has a transparent portion through which the flywheel can be seen which has reflectors attached thereto.

1 Claim, 4 Drawing Sheets

FLASH DEVICE FOR AN EXERCISE DEVICE

FIELD OF THE INVENTION

The present invention relates to a flash device, and more particularly, to a flash device for an exercise bicycle wherein an electrical generator is adjustably connected to, flywheel and a plurality of bulbs are attached to a casing of the exercise device so that when the flywheel is rotated, on (heep "on").

BACKGROUND OF THE INVENTION

A conventional exercise device such as the exercise bicycle generally has a crank which is rotated by user's feet, a pulley rotated by the rotation of the crank and a flywheel with a belt connected between the flywheel and the pulley so that the muscles of the user can be strengthened by overcoming the resistance of the flywheel and the belt. A casing is mounted to the mechanism comprising the pulley and the flywheel, and a seat and a handlebar respectively extend from the casing so that the user sits on the seat and holds the handlebar while rotating the crank. The operation of the exercise device is boring so some health clubs have televisions installed in the proximity of the exercise bicycle for the users. However, the user operating the exercise bicycle normally cannot watch the television because his/her head is moving or shaking when rotating the crank.

The present invention intends to provide a flush-mounted device connected to the exercise device and comprises an electrical generator connected to bulbs attached to the casing of the exercise device, the generator is operated by frictionally contacting the flywheel so that when the flywheel is rotated, the bulbs are turned on by the current generated by the generator.

The present invention provides a flush-mounted device which increases the interest of the users so as to resolve the disadvantages of the conventional exercise device.

SUMMARY OF THE INVENTION

In accordance with one aspect of the present invention, there is provided an exercise device having a flush-mounted device wherein the exercise device has a pulley with a crank extending therethrough and a flywheel connected to the pulley by a belt, a casing mounted over the pulley and the flywheel, and a seat and a handlebar respectively extending from the casing.

The flush-mounted device has an electrical generator with a rotator which adjustably contacts the flywheel so that the generator is operated by the rotation of the rotator which is rotated by the flywheel. A plurality of bulbs are electrically connected to the generator.

The object of the present invention is to provide a flush-mounted device for an exercise bicycle wherein the bulbs turn on when operating the exercise device such that the operation of the exercise device is fun.

Further objects, advantages, and features of the present invention will become apparent from the following detailed description with appropriate reference to the accompanying drawings.

DETAILED DESCRIPTION OF THE PREFERRED EMBODIMENTS

Figure 1:
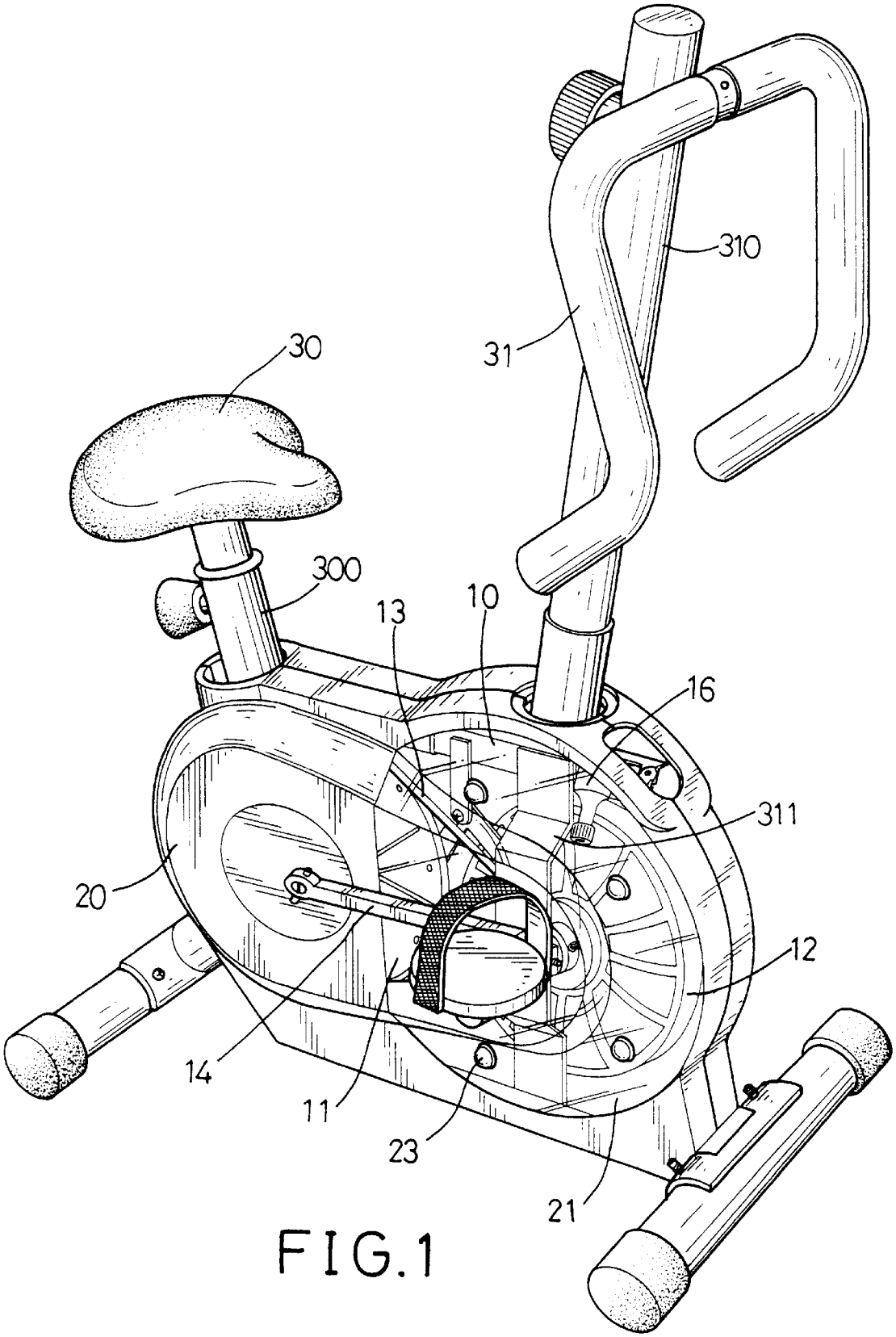
FIG. 1 is a perspective view of the exercise device having a flush-mounted device in accordance with the present invention.
Figure 2:
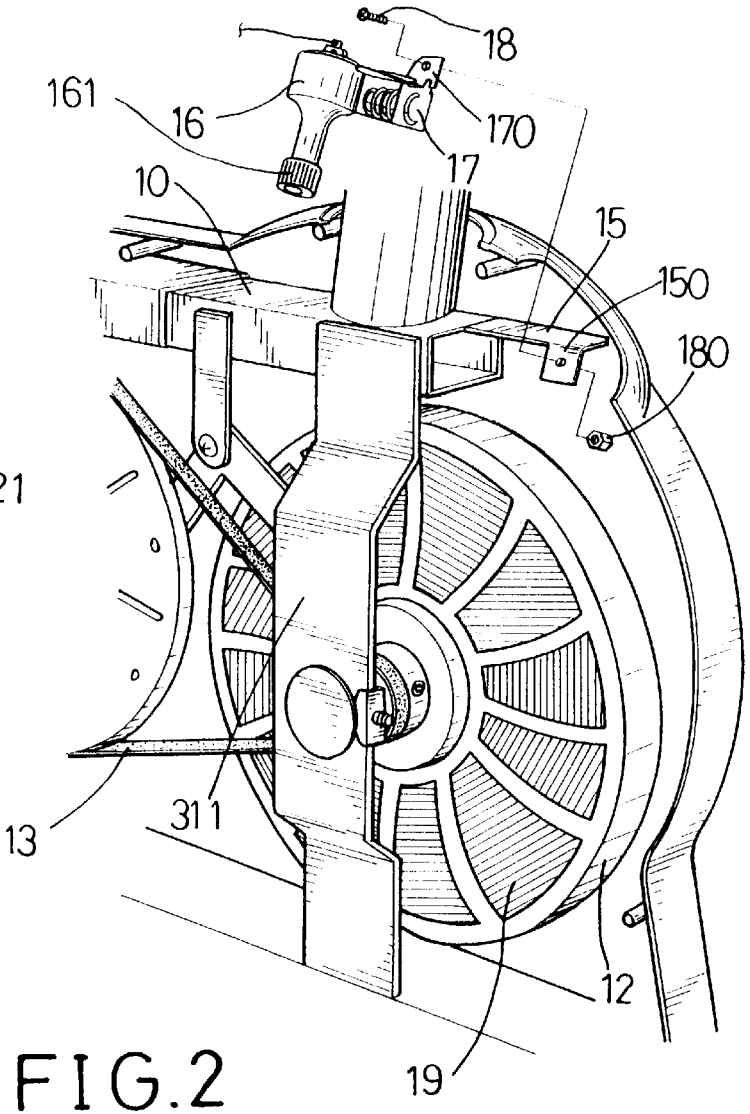
FIG. 2 is an exploded view of the generator, the flywheel and the casing in accordance with the present invention.
Figure 2:
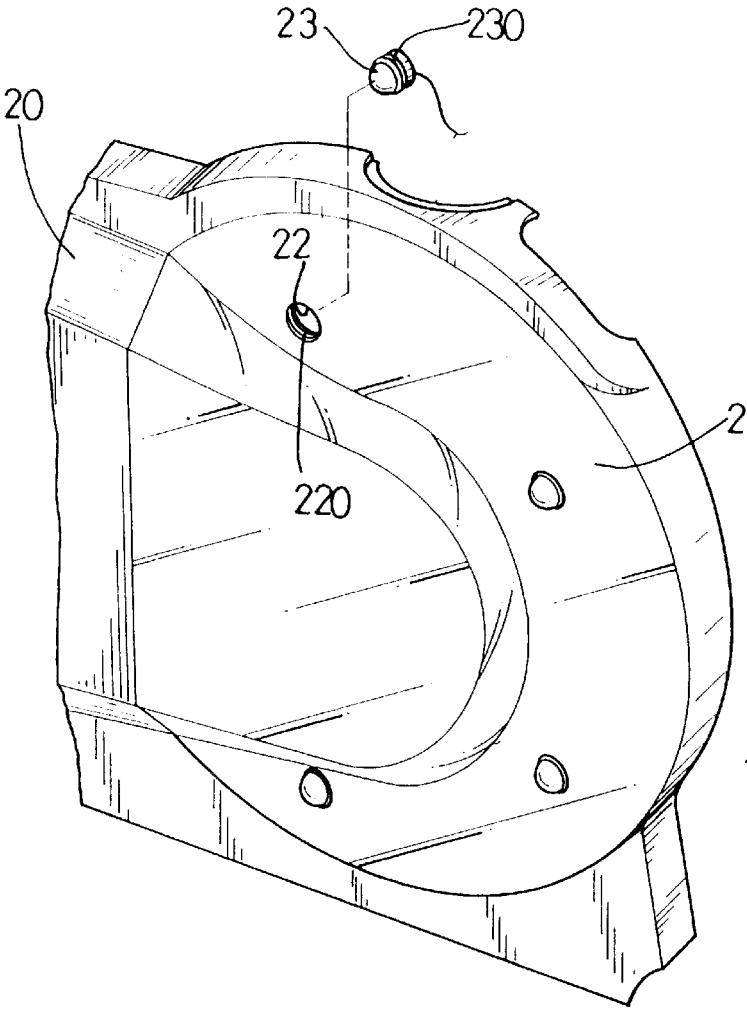
Figure 3:
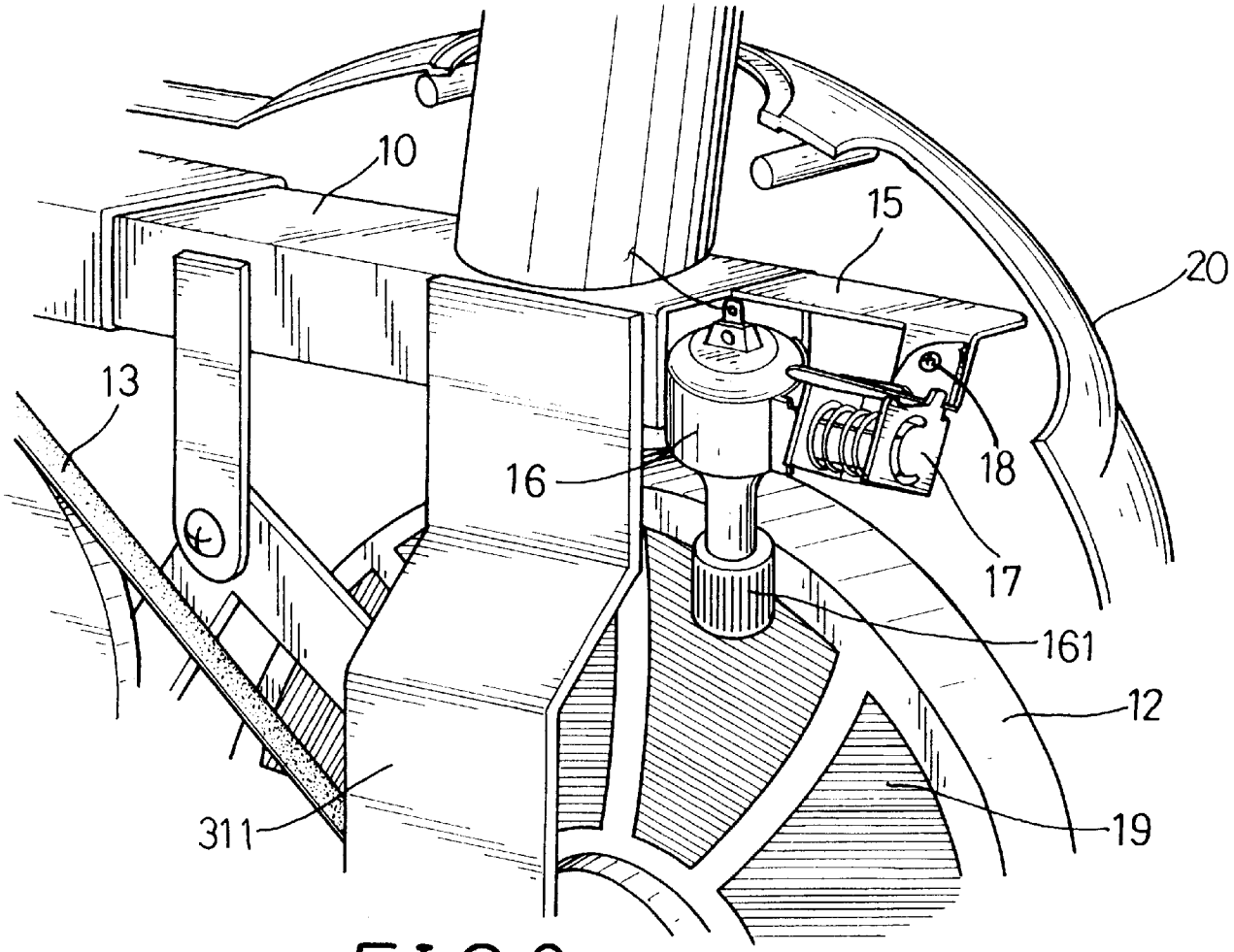
FIG. 3 is a perspective view of the generator and the flywheel in accordance with the present invention.

Referring to FIGS. 1 to 3, the exercise bicycle has a pulley (11) with a crank (14) extending through the pulley (11) and a flywheel (12) located adjacent to the pulley (11) with a belt (13) connected between the pulley (11) and the flywheel (12). A casing (20) is mounted over the pulley (11) and the flywheel (12), wherein the casing (20) has a transparent portion (21) through which the flywheel (12) can be seen. A seat post (300) extends from the casing (20) and a seat (30) is connected to the top of the seat post (300). A tube (310) extends from the casing (20) and has a fork portion (311) in which the flywheel (12) is rotatably connected, a handlebar (31) is connected to the top of the tube (310) so that the user may sit on the seat (30) and hold the handlebar (31) to rotate the crank (14) with his/her feet.

The flush-mounted device comprises a generator (16) which has a rotator (161) adjustably contacting the rim of the flywheel (12). An arm (17) extends from the generator (16) and a connecting plate (170) extends from the arm (17). A transverse tube (10) extends above the flywheel (12) and has an extension portion (15) with a lug (150) so that the connecting plate (170) and the lug (150) are connected together by a bolt (18) and a nut (180). Accordingly, the rotator (161 ) can be removed from the rim of the flywheel (12) by pivoting the generator (16). The generator (16) is operated by the rotation of the rotator (161) which is rotated by the flywheel (12). A plurality of reflectors (19) are bonded to the outside of the flywheel (12) so that there will be a beautiful scene when the flywheel (12) is rotated.

Figure 4:
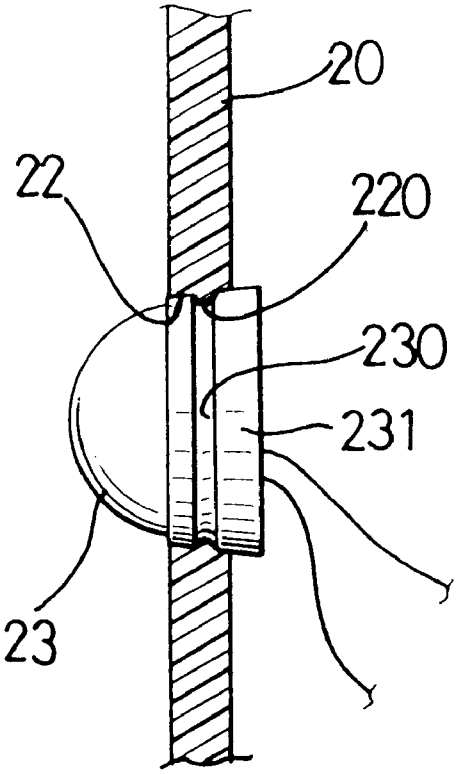
FIG. 4 is a side elevational view, partly in section, of the bulb engaged in the casing in accordance with the present invention.

Referring to FIG. 4, the casing (20) has a plurality of apertures (22) defined therethrough and an annular ridge (220) extending radially inward from the periphery defining each of the apertures (22). A plurality of bulbs (23) each has a frame (231) which has an annular groove (230) defined in the outside thereof so as to receive the annular ridge (220) therein. The bulbs (23) are electrically connected to the generator (16) so that when the user rotates the crank (14), the generator (16) is operated by the flywheel (12) and therefore turns the bulbs (23) on. The level of the brightness of the bulbs (32) varies based on the current generated by the generator (16) which further depends on the speed of the flywheel (12).

Figure 5:
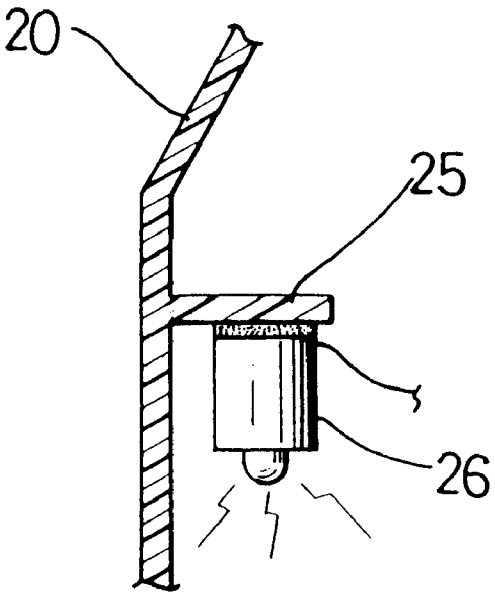
FIG. 5 is a side elevational view, partly in section, of a light connected to the casing.

FIG. 5 shows that the casing (20) has at least one plate (25) extending laterally inward from the inside thereof and a light (26) is connected to the plate (25) and directed toward the flywheel (12). The light (26) is electrically connected to the generator (16) so as to light up the reflectors (19).

Although the invention has been explained in relation to its preferred embodiment, it is to be understood that many other possible modifications and variations can be made without departing from the spirit and scope of the invention as hereinafter claimed.

What is claimed is:

1. An exercise device with a flash device comprising:

a pulley with a crank extending through said pully;

a flywheel located adjacent to said pulley and having reflectors attached thereto;

a belt connected between said pulley and said flywheel;

a casing mounted over said pulley and said flywheel, said casing having a transparent portion through which said flywheel can be seen;

a plurality of apertures defined through said casing and an annular ridge extending radially inward from a periphery defining each of said apertures;

at least one plate extending laterally inward from an inside of said casing and a light connected to said plate and directed toward said flywheel;

a seat and a handlebar respectively extending from said casing;

a generator having a rotator which adjustably contacts said flywheel and said generator is operated by the rotation of said rotator when said flywheel is rotated; and a plurality of bulbs electrically connected to said generator, each of said bulbs having a frame to which said bulb is connected, and said frame having an annular groove defined in an outside thereof so as to receive said annular ridge therein.

* * * * *